US009405272B2

(12) United States Patent
Wachi et al.

(10) Patent No.: US 9,405,272 B2
(45) Date of Patent: Aug. 2, 2016

(54) IMAGE FORMING APPARATUS INCLUDING A DUCT FILTER HAVING CORRUGATED SURFACE SHAPE

(71) Applicant: Panasonic Intellectual Property Management Co., Ltd., Osaka (JP)

(72) Inventors: Hayato Wachi, Fukuoka (JP); Youichi Idera, Fukuoka (JP); Masaya Shitami, Fukuoka (JP); Takanori Kitagawa, Fukuoka (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 0 days.

(21) Appl. No.: 14/608,058

(22) Filed: Jan. 28, 2015

(65) Prior Publication Data

US 2015/0212486 A1 Jul. 30, 2015

(30) Foreign Application Priority Data

Jan. 29, 2014 (JP) ..... 2014-014709

(51) Int. Cl.
*G03G 21/20* (2006.01)
*G03G 15/20* (2006.01)

(52) U.S. Cl.
CPC ..... *G03G 21/206* (2013.01); *G03G 15/2017* (2013.01); *G03G 15/2021* (2013.01)

(58) Field of Classification Search
CPC .. G03G 21/206; G03G 15/2017; G03G 21/20
USPC ..... 399/93
See application file for complete search history.

(56) References Cited

U.S. PATENT DOCUMENTS 4,728,426 A 3/1988 Rudinger et al.
6,126,707 A 10/2000 Pitzen (Continued)

FOREIGN PATENT DOCUMENTS

JP 62-132513 A 6/1987
JP 5-019582 1/1993

(Continued)

OTHER PUBLICATIONS

Extended European Search Report dated Jun. 2, 2015 for corresponding EP Application No. 15152455.0-1560, 7 pages.

*Primary Examiner* — Walter L Lindsay, Jr.
*Assistant Examiner* — Ruth Labombard
(74) *Attorney, Agent, or Firm* — Seed IP Law Group PLLC

(57) ABSTRACT

An image forming apparatus includes a fuser unit which includes a heat roller and a pressure roller; a duct which is formed in a long shape in a direction along an axis of the heat roller, is disposed in the vicinity of the fuser unit along the axis of the heat roller, and is exhausted by an exhaust fan which is provided on one end side in a long-side direction; an exhaust port which is opened to a first side wall of the fuser unit side of the duct and causes the fuser unit and the duct to communicate with each other; and a planar filter which is attached to an inner wall surface of the duct. The filter includes a filter base material having an irregular surface shape in which ditches and convex portions are alternately disposed; and a frame which is bonded to both ends orthogonal to an irregularity direction of the filter base material, the convex portion of the filter base material protrudes from the frame, and the convex portion of the filter base material is bonded or stuck to the inner wall surface.

9 Claims, 9 Drawing Sheets

(56) References Cited

U.S. PATENT DOCUMENTS

| | | | |
|---|---|---|---|
| 7,526,223 | B2 | 4/2009 | Adachi et al. |
| 7,747,186 | B2 | 6/2010 | Miyamoto et al. |
| 2007/0059020 | A1 | 3/2007 | Yoshikawa |
| 2008/0145092 | A1 | 6/2008 | Tomatsu et al. |
| 2009/0290897 | A1 | 11/2009 | Doshoda et al. |
| 2011/0211859 | A1 | 9/2011 | Shimoyama et al. |
| 2014/0056608 | A1 | 2/2014 | Miura |

FOREIGN PATENT DOCUMENTS

| | | | |
|---|---|---|---|
| JP | 7-171325 | | 7/1995 |
| JP | 10-268735 | | 10/1998 |
| JP | 11-047531 | A | 2/1999 |
| JP | 2001-117472 | | 4/2001 |
| JP | 2002-58943 | A | 2/2002 |
| JP | 2002-318514 | A | 10/2002 |
| JP | 2003-140514 | A | 5/2003 |
| JP | 2003-181231 | A | 7/2003 |
| JP | 2006-208718 | | 8/2006 |
| JP | 2007-079184 | A | 3/2007 |
| JP | 2008-139703 | | 6/2008 |
| JP | 2009-145729 | | 7/2009 |
| JP | 2009-192679 | | 8/2009 |
| JP | 2009-192679 | A | 8/2009 |
| JP | 2009-282455 | A | 12/2009 |
| JP | 2011-107500 | | 6/2011 |
| JP | 2011-180235 | A | 9/2011 |
| JP | 2011-180283 | A | 9/2011 |
| JP | 2012-032663 | | 2/2012 |
| JP | 2013-033197 | | 2/2013 |
| JP | 2014-044238 | | 3/2014 |
| JP | 5506071 | | 5/2014 |
| JP | 5595610 | | 9/2014 |

IMAGE FORMING APPARATUS INCLUDING A DUCT FILTER HAVING CORRUGATED SURFACE SHAPE

BACKGROUND OF THE INVENTION

1. Field of the Invention

The present invention relates to an image forming apparatus.

2. Description of the Related Art

In an electrophotographic image forming apparatus, it is known that a plurality of kinds of chemical substances are discharged from an image forming apparatus during image forming. For example, as a representative of the discharged chemical substances, there is ozone generated when a photosensitive drum is charged, or toner dust generated during developing or fusing. In the related art, in order to not allow the generated chemical substances to be discharged outside the image forming apparatus, for example, a measure of providing a filter or the like is performed.

In a volatile chemical substance collection device of an electronic apparatus disclosed in Japanese Patent Unexamined Publication No. 2009-282455, a technology is disclosed in which an electric field is generated in an atmosphere from an electric field generating collection member in an exhaust duct provided above a fuser unit, and volatile organic compounds (VOC) included in the atmosphere are drawn to the surface of the electronic field generating collection member by the operation of the electric field so as to be collected.

In an image forming apparatus disclosed in Japanese Patent Unexamined Publication No. 2011-180235, a technology is disclosed as follows. That is, a duct which includes a take-in port for taking-in minute particles generated from a heat roller inside a fusing device is provided in the vicinity of the fusing device. An exhaust fan which generates a flow of air from the take-in port toward an outlet is provided in an expansion portion of the duct, and a first filter member is provided on the upstream side of the exhaust fan. The first filter member captures ultrafine particles (for example, siloxane) generated from a rubber layer configuring the fusing device. A shutter which closes a gap between the first filter member and the expansion portion is provided, and a control portion of the image forming apparatus switches a state where the shutter closes a first filter portion and a state where the shutter does not close the first filter portion according to a predetermined initial burst condition.

In an odor removing device of a multi-function image forming apparatus disclosed in Japanese Patent Unexamined Publication No. 2011-180283, a technology is disclosed as follows. That is, a plurality of air passage portions for introducing air inside a housing are formed on a housing bottom portion. Each air passage portion is a cylindrical body in which an inner diameter of the upper portion side inside the housing is smaller than an inner diameter of the housing bottom portion, and an ozone decomposition filter including an ozone decomposition catalyst is disposed on an inner diameter surface of the cylindrical body. A waste liquid absorbing material is disposed on the bottom portion inside the housing, a deodorizing absorbent is disposed on an upper cover inside the housing, and an exhaust port of the air passing through a portion between the waste liquid absorbing material and the deodorizing absorbent is provided on the side surface of the housing.

Japanese Patent Unexamined Publication No. 2002-8943 discloses a technology, in which a filter is pleat-molded into a cross-sectional wave shape, and thus, a surface area of a filter base material is increased and deodorization performance is improved.

SUMMARY OF THE INVENTION

According to an exemplary embodiment of the present invention, there is provided an image forming apparatus including: a fuser unit which includes a heat roller and a pressure roller which heats and pressurizes a sheet on which an unfused toner image is carried and fuses the unfused toner image on the sheet; a duct which is formed in a long shape in a direction along an axis of the heat roller, is disposed in the vicinity of the fuser unit along the axis of the heat roller, and is exhausted by an exhaust fan which is provided on one end side in a long-side direction; an exhaust port which is opened to a first side wall of the fuser unit side of the duct and causes the fuser unit and the duct to communicate with each other; and a planar filter which is attached to an inner wall surface of the duct, in which the filter includes a filter base material having an irregular surface shape in which ditches and convex portions are alternately disposed and a frame which is bonded to both ends orthogonal to an irregularity direction of the filter base material, and the convex portion of the filter base material protrudes from the frame, and the convex portion of the filter base material is bonded or stuck to the inner wall surface.

BRIEF DESCRIPTION OF DRAWINGS

FIG. 2 is cut at an approximately center position in a long-side direction of a heat roller;

FIG. 3 is viewed from the lower portion of a duct side;

DETAILED DESCRIPTION OF THE PREFERRED EMBODIMENTS

Hereinafter, an embodiment (hereinafter, referred to as the "present embodiment") of an image forming apparatus according to the present invention will be described with reference to the drawings. In the present embodiment below, as an example of the image forming apparatus according to the present invention, an electrophotographic multi-function printer will be described. However, the image forming apparatus according to the present invention is not limited to the multi-function printer, and for example, may be also applied to a copier or printer.

Figure 1:
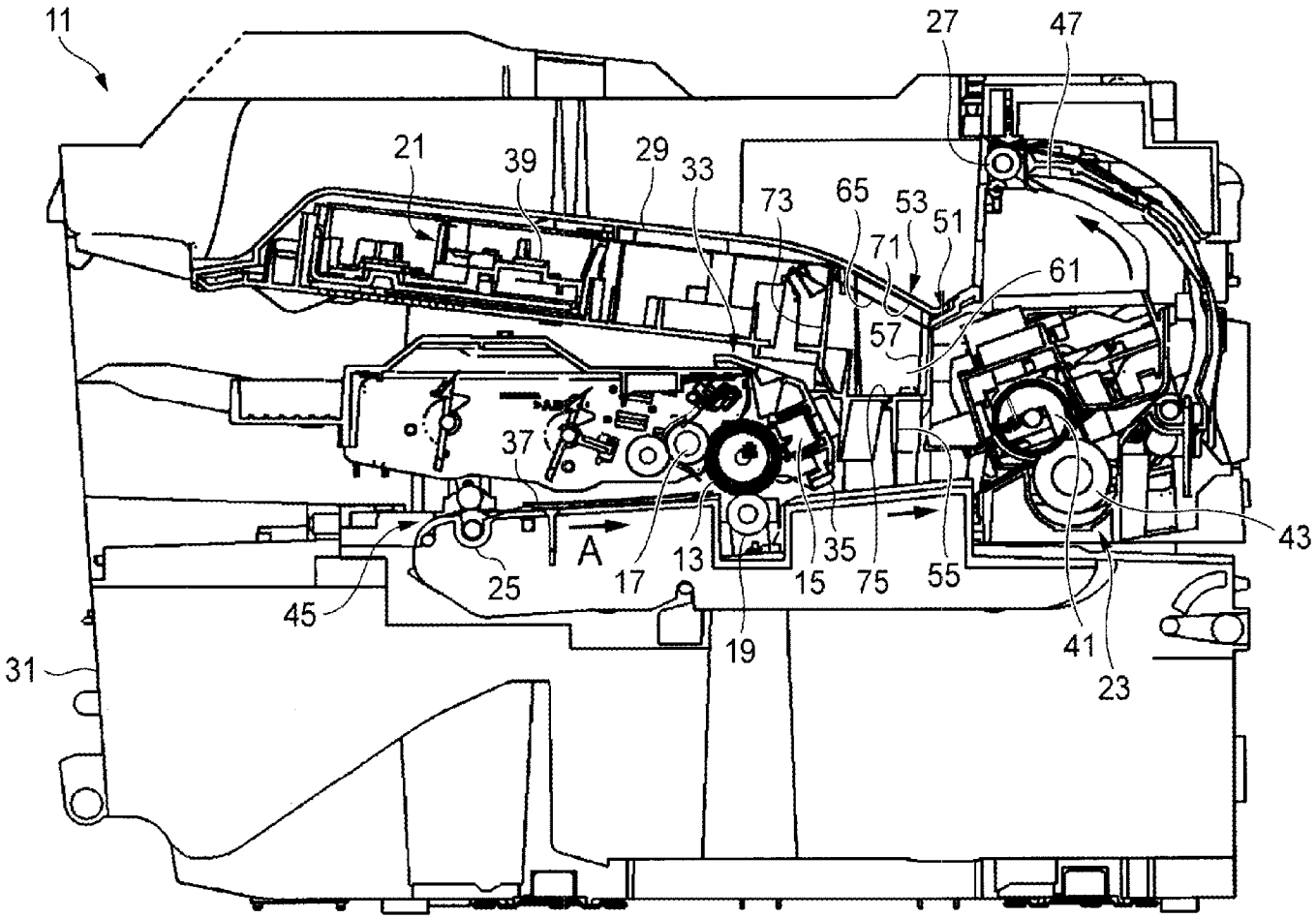
FIG. 1 is a longitudinal cross-sectional view of a multi-function printer of the present embodiment.
Figure 2:
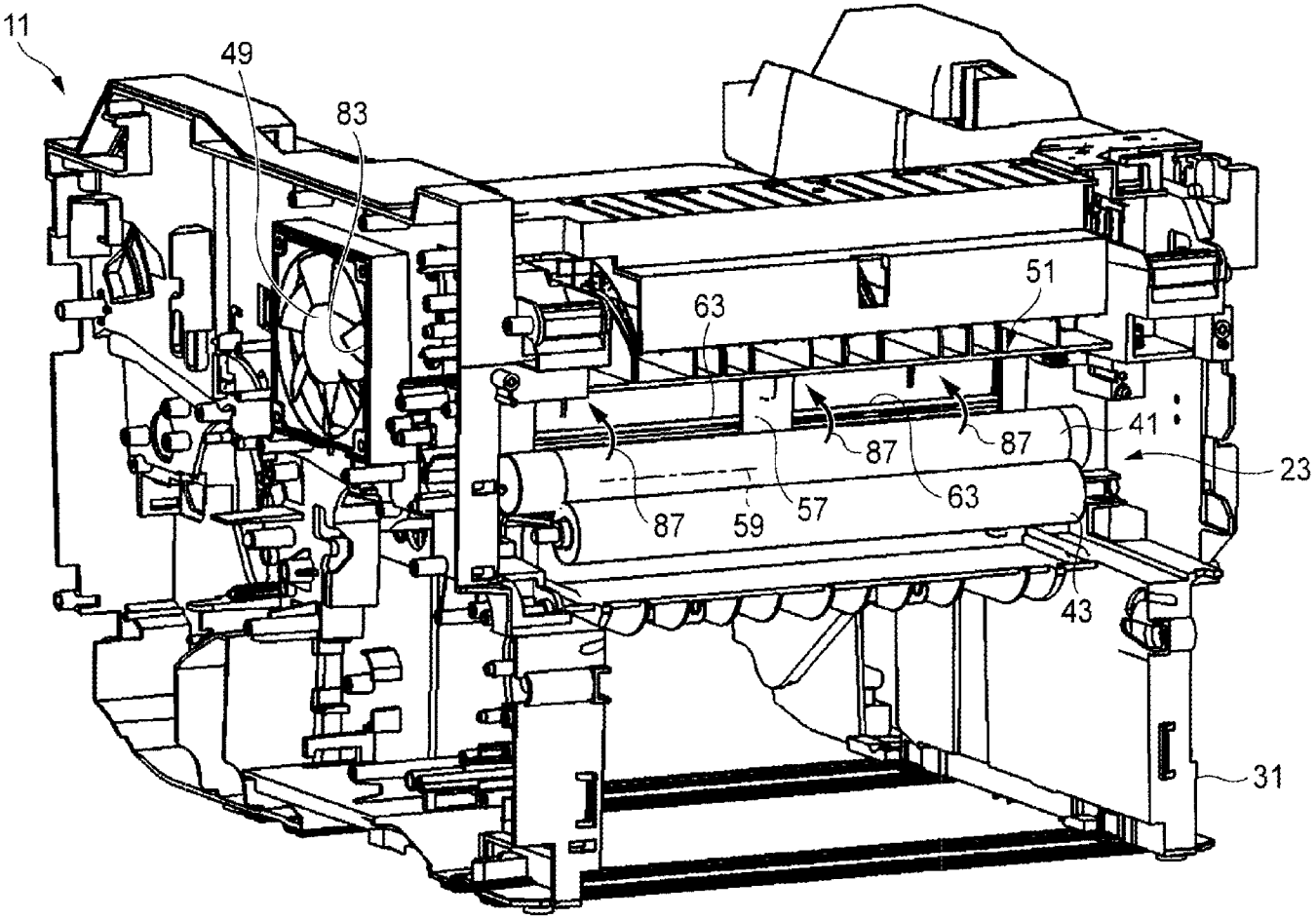
FIG. 2 is a perspective view when a first side wall of the multi-function printer shown in FIG. 1 is viewed from a fuser unit container side.
Figure 3:
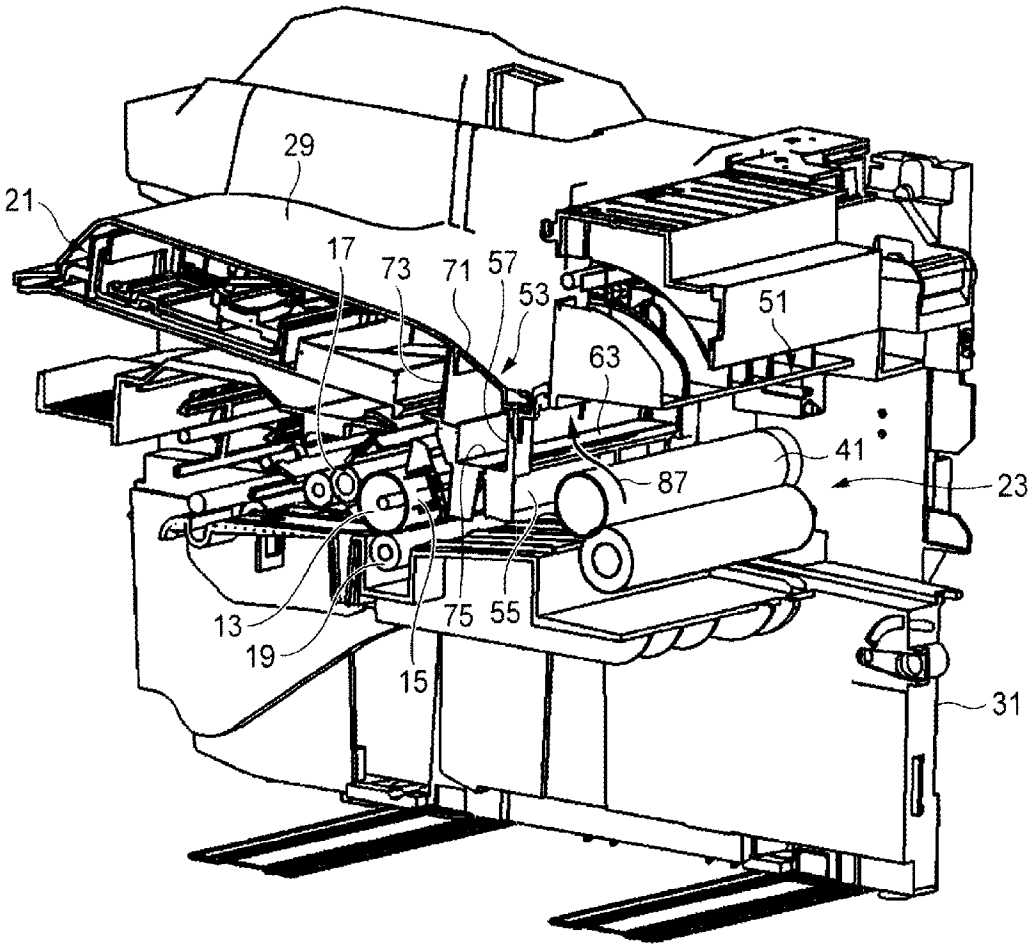
FIG. 3 is a perspective view when
Figure 4:
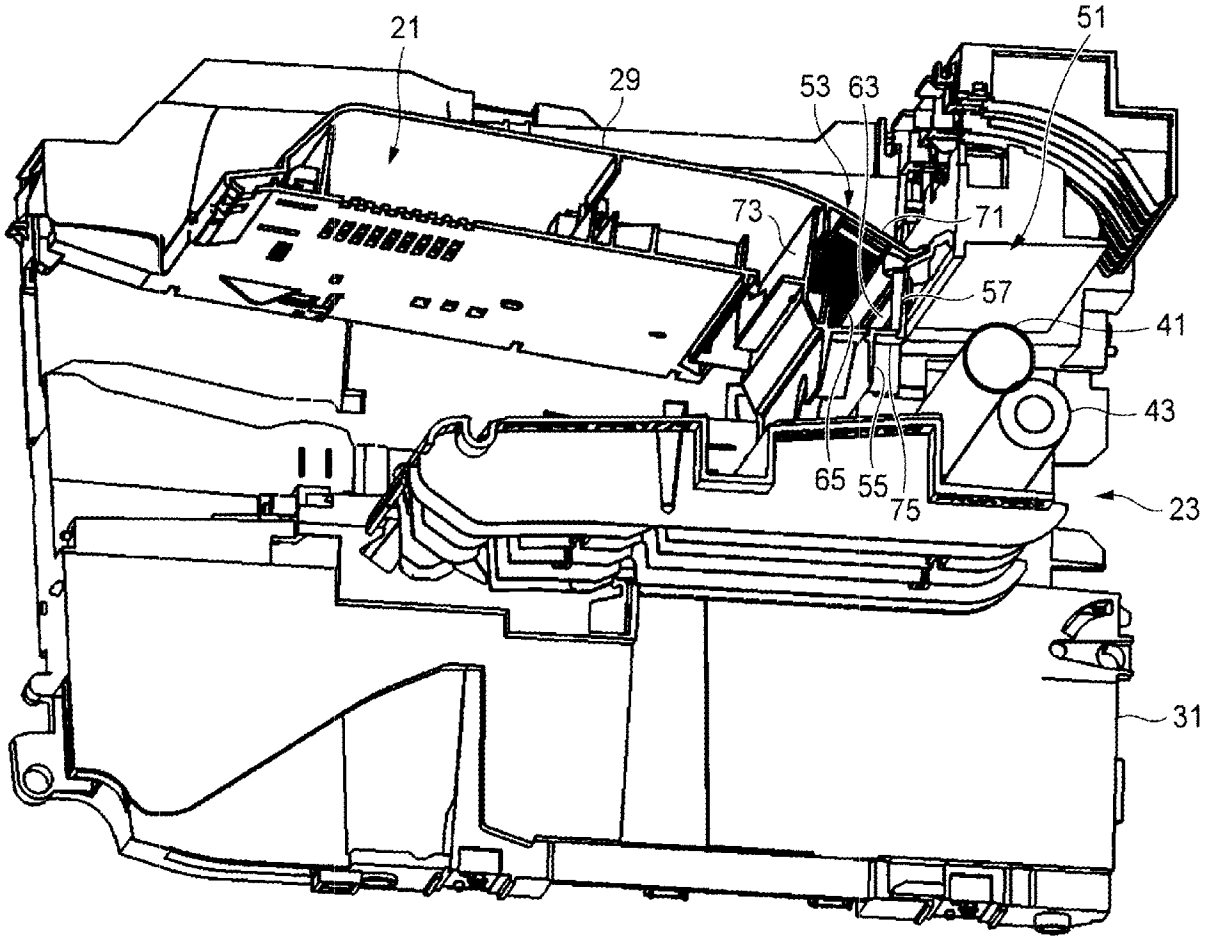
FIG. 4 is a perspective view when
Figure 5:
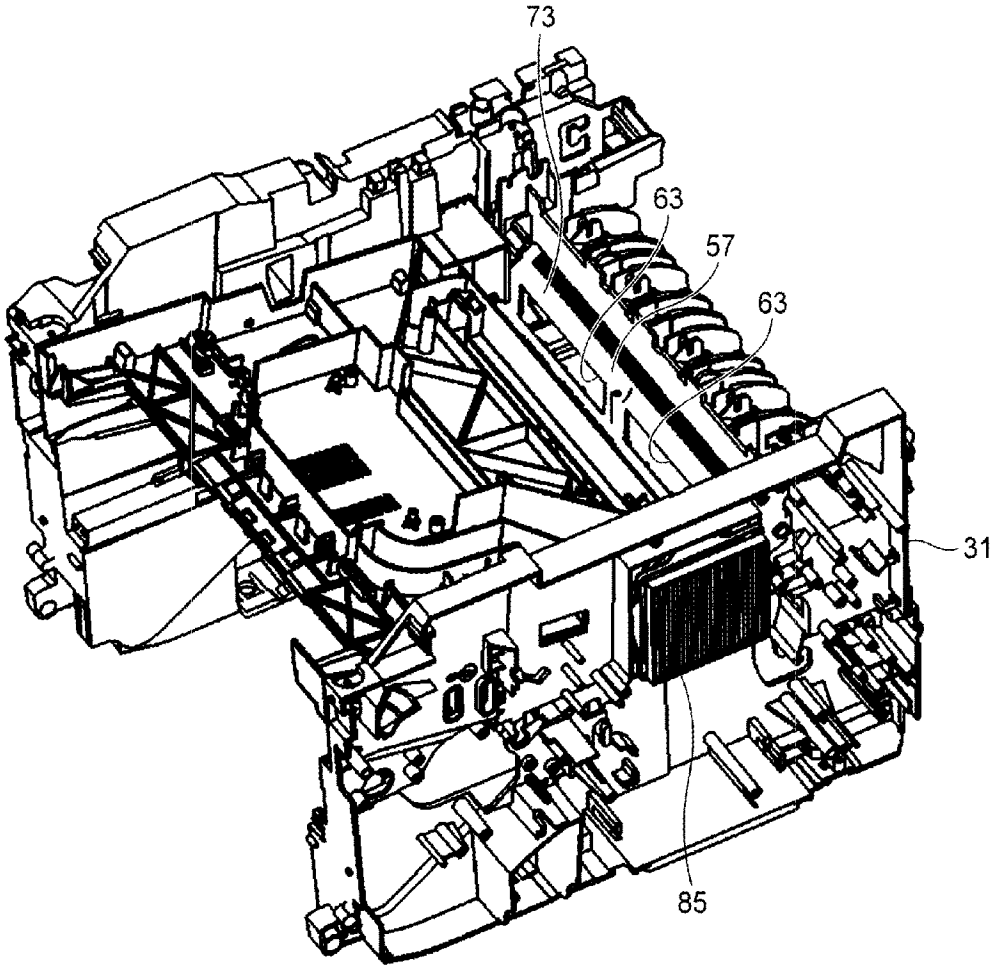
FIG. 5 is a perspective view when an exhaust port of a first side wall is viewed from the upper portion in a state where a ceiling surface of the duct is not shown.
Figure 6:
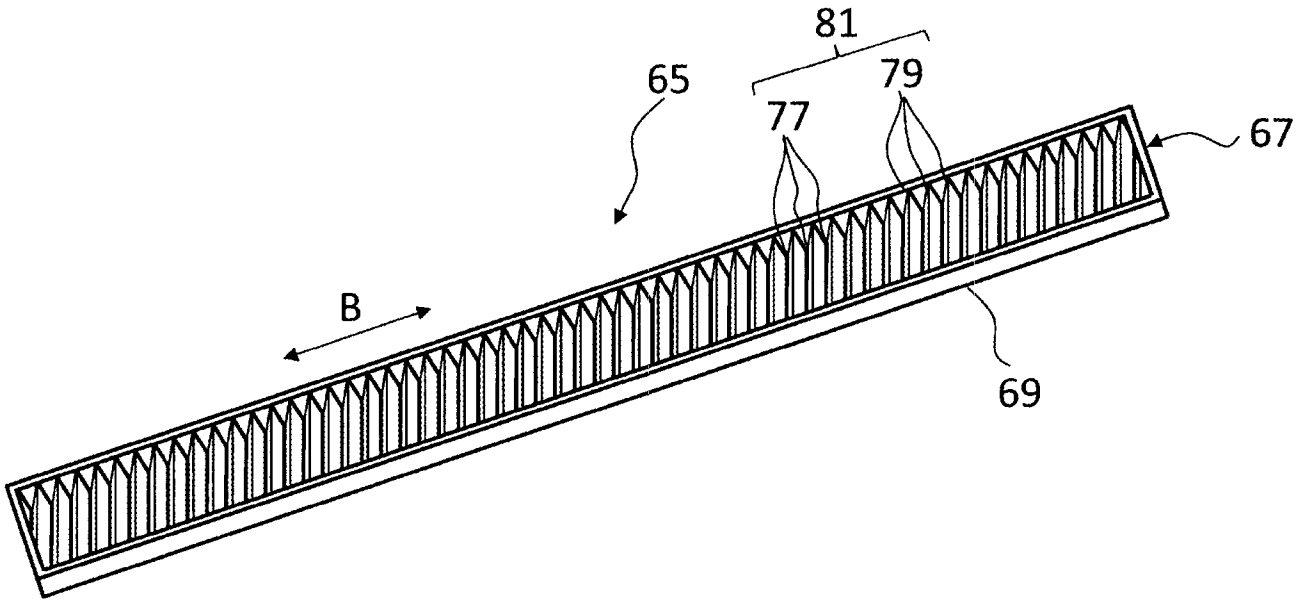
FIG. 6 is a perspective view of a filter in which ditches and convex portions extend so as to be orthogonal to each other in a long-side direction of the duct.
Figure 7:
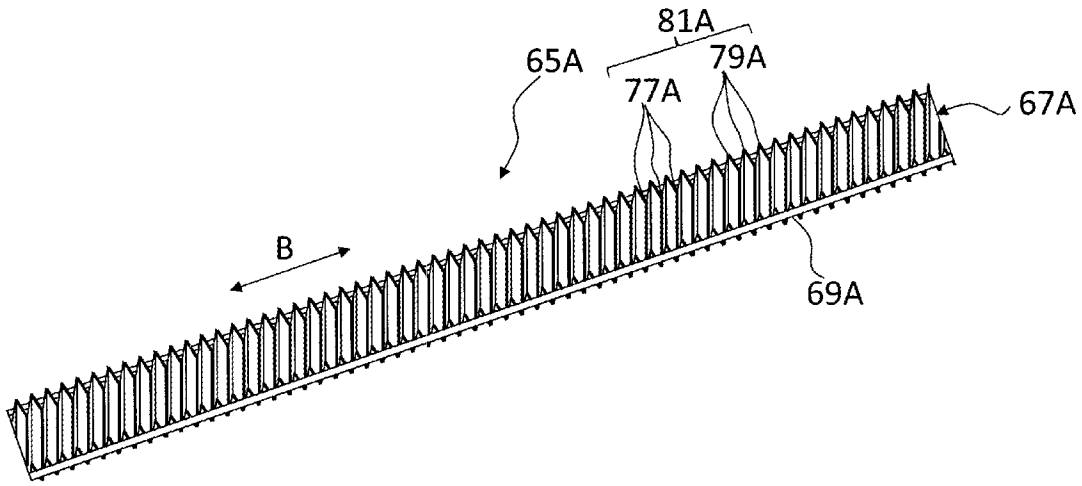
FIG. 7 is a perspective view of a filter in which ditches and convex portions extend in an inclination direction in the long-side direction of the duct.
Figure 8:
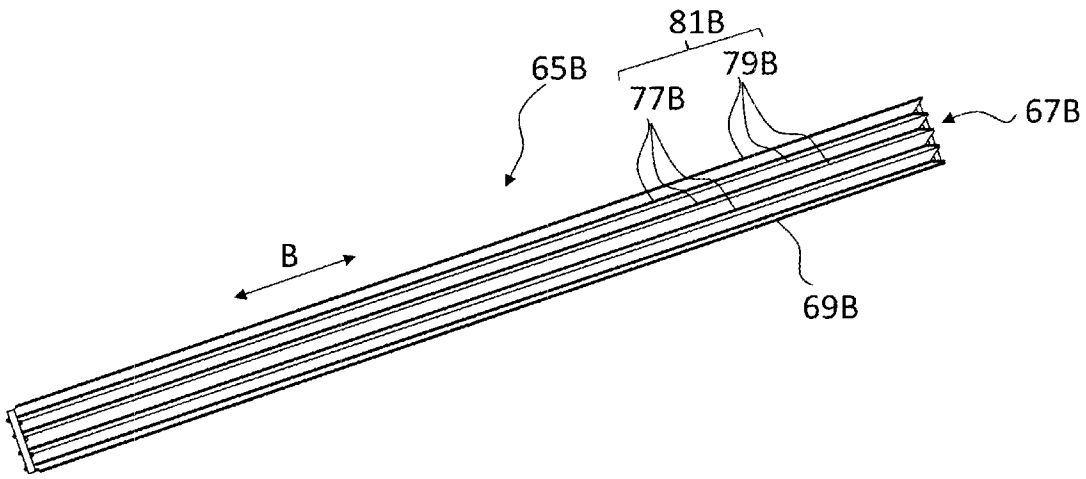
FIG. 8 is a perspective view of a filter in which ditches and convex portions extend so as to be parallel with each other in the long-side direction of the duct.
Figure 9:
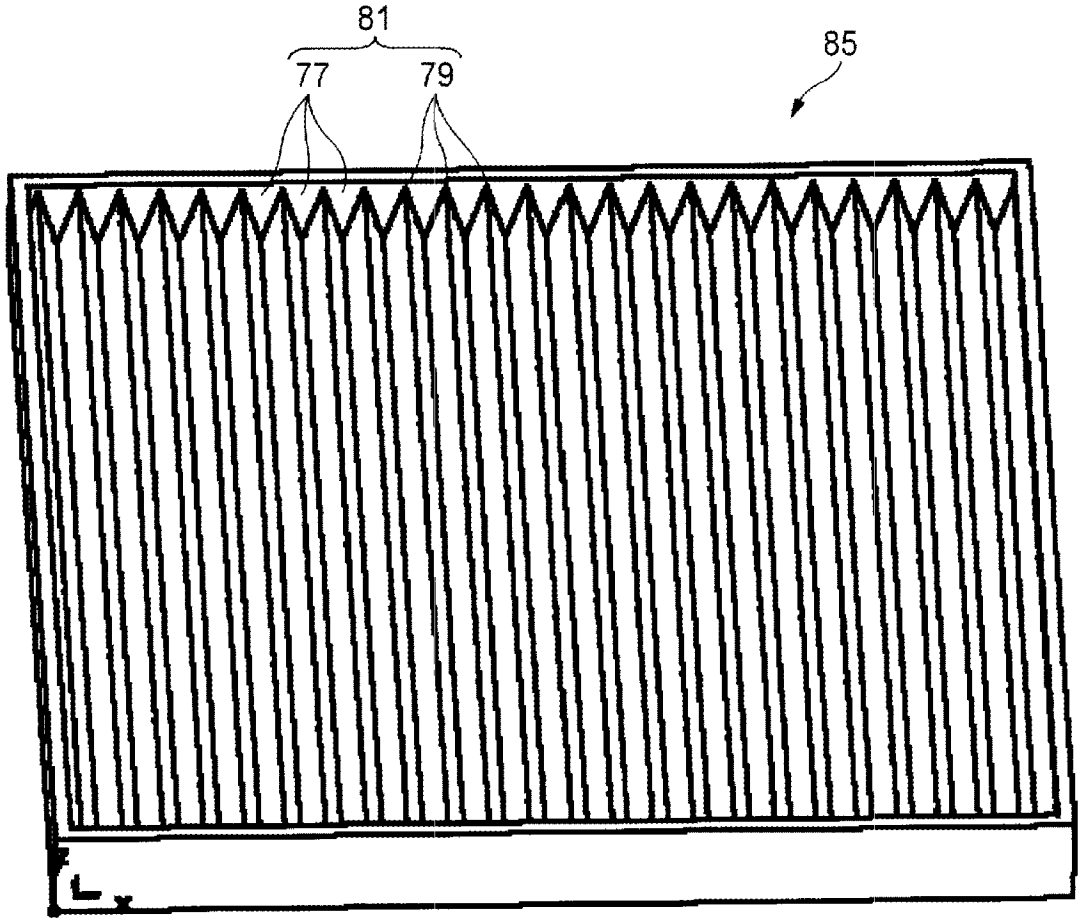
FIG. 9 is a perspective view of a thru-beam type filter.

FIG. 1 is a longitudinal cross-sectional view of multi-function printer 11 of the present embodiment. FIG. 2 is a perspective view when first side wall 57 of multi-function printer 11 shown in FIG. 1 is viewed from fuser unit container 51 side. FIG. 3 is a perspective view when FIG. 2 is cut at an approximately center position in a long-side direction of heat roller 41. FIG. 4 is a perspective view when FIG. 3 is viewed from the lower portion of duct 53 side. FIG. 5 is a perspective view when exhaust port 63 of first side wall 57 is viewed from the upper portion in a state where ceiling surface 71 of the duct is not shown. FIG. 6 is a perspective view of filter 65 in which ditches 77 and convex portions 79 extend so as to be orthogonal to each other in a long-side direction of duct 53. FIG. 7 is a perspective view of filter 65A in which ditches 77A and convex portions 79A extend in an inclination direction in the long-side direction of duct 53. FIG. 8 is a perspective view of filter 65B in which ditches 77B and convex portions 79B extend so as to be parallel with each other in the long-side direction of duct 53. FIG. 9 is a perspective view of thru-beam type filter 85.

For example, multi-function printer 11 of the present embodiment includes functions such as scanning, copying, or printing, form (fuses) a monochromatic or multicolor image on a sheet (for example, a recording material or a recording sheet) based on print job data input from an external device (for example, a personal computer (PC) (not shown)), and discharges the sheet.

Multi-function printer 11 shown in FIG. 1 is configured to include at least photosensitive drum 13, charging unit 15, developing roller 17, transfer roller 19, exposure device 21, fuser unit 23, sheet feeding cassette (not shown), sheet transport roller 25, sheet discharging roller 27, and sheet discharging tray 29 in main body casing 31.

For example, one set of visible image forming units (process units) 33 is disposed at an approximately center inside main body casing 31 of multi-function printer 11 shown in FIG. 1. For ease of explanation, for example, it is described that one set of visible image forming units 33 is disposed to form a black image in multi-function printer 11 shown in FIG. 1. However, the visible image forming unit having the similar configuration for each different color (yellow, magenta, cyan) may be disposed.

Photosensitive drum 13 which has a role as an electrostatic latent image carrier according to print job data input into multi-function printer 11 is provided in visible image forming unit 33, and charging unit 15, developing roller 17, transfer roller 19, and cleaning unit 35 are disposed in the vicinity of photosensitive drum 13.

Charging unit 15 uniformly charges a predetermined potential (for example, negative potential) on the surface of photosensitive drum 13. For example, preferably, charging unit 15 is a charge roller type which can uniformly charge the surface of photosensitive drum 13 without generating ozone as much as possible during charging with respect to photosensitive drum 13. However, charging unit 15 is not limited to the charge roller type, and for example, may use a contact type brush or a non-contact charger type.

Developing roller 17 develops electrostatic latent image formed on photosensitive drum 13 by exposure device 21 described below using toner supplied to developing roller 17. Accordingly, a toner image corresponding to the print job data is obtained. In the present embodiment, for example, black toner is supplied to developing roller 17. In multi-function printer 11, toner of each color may be supplied to each developing roller of a visible image forming unit corresponding to each color of yellow, magenta, and cyan, and having the same configuration as the visible image forming unit 33.

Transfer roller 19 is disposed to oppose photosensitive drum 13, and transfers the toner image formed on the surface of photosensitive drum 13 to sheet 37 which is transported along sheet transport path 45. Hereinafter, the toner image transferred to sheet 37 by transfer roller 19 is referred to as an "unfused toner image".

Cleaning unit 35 removes and recovers the toner which remains on the surface of photosensitive drum 13 after the transfer processing is performed in transfer roller 19.

Exposure device 21 includes a laser scanning unit (LSU) 39. Laser scanning unit 39 is configured to include a laser light source, a polygon mirror which performs scanning with the laser light emitted from the laser light source, a lens which introduces the laser light which performs the scanning by the polygon mirror into photosensitive drum 13, and a reflecting mirror. Laser scanning unit 39 exposes the surface of photosensitive drum 13 by the light from the polygon mirror according to the input print job data, and forms the electrostatic latent image according to the print job data on photosensitive drum 13.

Fuser unit 23 is configured to include heat roller 41 and pressure roller 43 which extend so as to be perpendicular to sheet 37. Heat roller 41 is heated to a predetermined target temperature (for example, fuse temperature within a range from 180° C. to 200° C.) by a heater which is a heat source. Pressure roller 43 is biased toward heat roller 41 by a spring (not shown). Fuser unit 23 heats and pressurizes sheet 37 to which the toner image is transferred in pressure roller 43 and heat roller 41, and thus, the unfused toner image is fused on sheet 37.

Sheet transport path 45 is formed from a sheet feeding cassette (not shown) to sheet discharging tray 29 in main body casing 31. Sheet transport path 45 is configured of a transport path which passes through fuser unit 23 from sheet transport roller 25 via a portion between photosensitive drum 13 and transfer roller 19, and reaches sheet discharging roller 27 (refer to an arrow A in FIG. 1). Sheet transport path 45 becomes sheet discharging path 47 immediately before sheet discharging roller 27. For example, a switchback transport path (not shown) for feeding sheet 37 to the position of transfer roller 19 again when a duplex printing is performed is provided in sheet discharging path 47.

A control portion (not shown) for integrally controlling all operations of multi-function printer 11 is provided in main body casing 31. The control portion is configured using a processor (for example, Central Processing Unit (CPU), Micro Processing Unit (MPU), and Digital Signal Processor (DSP)). The control portion controls each operation in each portion of multi-function printer 11, that is, photosensitive drum 13, charging unit 15, developing roller 17, transfer roller 19, exposure device 21, fuser unit 23, sheet transport roller 25, and sheet discharging roller 27. Control portion also controls the operation of exhaust fan 49 (refer to FIG. 2) described below.

In multi-function printer 11 having the above-described configuration, an image forming process is performed as follows by control portion of multi-function printer 11.

When the image forming is performed, first, sheets 37 are discharged from a sheet feeding cassette (not shown) to sheet transport path 45 one by one using sheet transport roller 25.

After charging unit 15 uniformly charges the surface of photosensitive drum 13, exposure device 21 exposes a charge region on the surface of photosensitive drum 13 by laser light according to the print job data input from the external device.

Accordingly, the electronic latent image corresponding to the print job data is formed on the surface of photosensitive drum 13. Continuously, developing roller 17 develops the electronic latent image formed on the surface of the photosensitive drum 13 using the toner supplied by developing roller 17. Accordingly, the toner image corresponding to the print job data is obtained.

Transfer roller 19 transfers the toner image formed on the surface of photosensitive drum 13 to sheet 37 which is fed from the sheet feeding cassette (not shown) by sheet transport roller 25 and is transported. Accordingly, the unfused toner image corresponding to the print job data is transferred to sheet 37. The unfused toner image transferred to sheet 37 is transported to fuser unit 23. Fuser unit 23 sufficiently heats and pressurizes the unfused toner image in heat roller 41 and pressure roller 43 and fuses the unfused toner image on sheet 37. Accordingly, the image corresponding to the print job data is formed on sheet 37, and sheet 37 is discharged to sheet discharging tray 29 by sheet discharging roller 27.

Here, in multi-function printer 11 of the present embodiment, fuser unit container 51 for accommodating fuser unit 23 is provided in the vicinity of fuser unit 23. Fuser unit container 51 is formed as a cavity which has airtightness on a level in which the ultrafine particles (UFP) generated inside fuser unit container 51, that is, in fuser unit 23 are not leaked to the outside of fuser unit container 51.

More specifically, fuser unit container 51 is formed by connecting a plurality of metal plates and molding resin plates fixed to main body casing 31 to one another. Since fuser unit container 51 becomes a negative pressure by suction of exhaust fan 49 described below, existence of a small gap such as sheet transport path 45 communicating with the outside of the cavity is admitted. Outside air flows into fuser unit container 51 from the gap, and thus, fuser unit container 51 does not become a vacuum. An exclusive air feeding port may be provided in fuser unit container 51.

Duct 53 is provided so as to be adjacent to fuser unit container 51. Duct 53 is formed in a long shape in a direction along axis 59 (refer to FIG. 2) of heat roller 41, and is disposed in the vicinity of fuser unit 23 along axis 59 of heat roller 41. More specifically, duct 53 is formed in a long shape in the direction along axis 59 (refer to FIG. 2) of heat roller 41 with a portion of wall portion 55 in fuser unit container 51 as first side wall 57. Exhaust fan 49 (refer to FIG. 2) is provided on one end side in a long-side direction of duct 53, and exhaust fan 49 exhausts exhaust emissions including air existing in air transport space 61 (refer to FIG. 1) of duct 53 to the outside of main body casing 31.

Exhaust port 63 (refer to FIG. 2) is opened to first side wall 57 of fuser unit 23 side of duct 53, that is, first side wall 57 of wall portion 55 of fuser unit container 51. Exhaust port 63 causes fuser unit 23 and duct 53 to communicate with each other. More specifically, exhaust port 63 causes fuser unit container 51 which is provided so as to cover fuser unit 23 and duct 53 to communicate with each other. In the present embodiment, as shown in FIG. 2, a plurality of (two in FIG. 2) exhaust ports 63 are formed in the long-side direction of first side wall 57. A gap between exhaust ports 63 and an opening area of each exhaust port are set after container exhaust gas 87 described below is adjusted so as to be exhausted without variation in the long-side direction of fuser unit container 51.

Planar filter 65 is detachably attached to the inner wall surface of duct 53 so as to be parallel with inner wall surface. Since filter 65 is disposed so as to be parallel with the inner wall surface, it is possible to easily perform direct fixation with respect to the inner wall surface using a bonding agent, a double-sided adhesive tape, or the like. In duct 53, since filter 65 is directly fixed to the inner wall surface, a decrease in air transport space 61 is suppressed to the minimum. The inner wall surface of duct 53 is used as a collective name of ceiling surface 71, first side wall 57, second side wall 73, and bottom surface 75 of the duct.

As shown in FIG. 6, filter 65 includes filter main body 67 which is a filter base material formed in the shape of irregular surface 81, and frame body 69 which is a frame. In filter main body 67, ditches 77 and convex portions 79 are alternately disposed. Frame body 69 is bonded to both ends orthogonal to an irregularity direction of filter main body 67. Ditches 77 and convex portions 79 of filter main body 67 protrude from frame body 69. "Both ends orthogonal to the irregularity direction" are a pair of ends which is positioned on both sides toward a direction in which irregularities are arranged. Frame body 69 is fixed to both ends of filter main body 67.

For example, in the configuration of filter 65 of the present embodiment, ditches 77 and convex portions 79 are formed of V grooves, and crest portions in which V grooves are vertically inverted. The lowest portion of the V groove becomes a valley bottom at which a pair of valley surfaces crosses each other. The highest portion of the crest portion is an apex at which a pair of inclined sides crosses each other. Since filter main body 67 is formed to be folded upwardly or downwardly, the valley bottom and the apex have opposite phases on the front and rear surfaces. That is, the valley bottom on the front surface becomes the apex on the rear surface.

Frame body 69 of filter 65 may be formed of band shaped non-woven fabrics. Since frame body 69 is formed of non-woven fabrics, in addition to filter main body 67, lots of minute voids, that is, fiber clearances and holes are also formed in frame body 69. Accordingly, compared to a case where frame body 69 is formed of materials such as metal or resin which are not non-woven fabrics, in filter 65, it is possible to increase efficiency of the entire filter 65 of capturing ultrafine particles.

In duct 53, a rectangular ceiling surface (ceiling surface 71 of the duct) of duct 53 in which the inner wall surface is along the long-side direction of duct 53 is formed. Filter 65 is attached so as to be parallel with ceiling surface 71 of the duct. Specifically, preferably, filter is installed in a rectangular shape which covers ceiling surface 71 of the duct. As a result, if filter 65 has an area which can cover almost the entire ceiling surface 71 of the duct, filter 65 may be a single filter or a plurality of divided filters.

Filter 65 may be installed to cover all or a portion of first side wall 57, second side wall 73, and bottom surface 75 in addition to ceiling surface 71 of the duct. However, when filter 65 is provided on first side wall 57, filter is provided on a portion other than exhaust port 63 so that exhaust port 63 is not blocked.

Ceiling surface 71 of the duct is formed to be upwardly inclined so as to be heightened as ceiling surface 71 is away from exhaust port 63. In first side wall 57 and second side wall 73 opposing first side wall which are positioned in a state where ceiling surface 71 of the duct is interposed therebetween, an included angle between first side wall 57 and ceiling surface 71 and an included angle between second side wall 73 and ceiling surface 71 become acute angles.

As shown in FIG. 6, the surface of filter 65 is configured so as to have irregular surface 81 in which ditches 77 and convex portions 79 parallel with each other to be extended so as to be orthogonal to the long-side direction of duct 53 are alternately disposed in the long-side direction (arrow B direction in FIG. 6) of ceiling surface 71 of the duct. Since filter 65 has irregular surface 81, the surface area is increased.

Ditch 77 and convex portion 79 configuring irregular surface 81 may be formed in various shapes. For example, although it is not shown, ditch 77 may be formed in a V ditch, and convex portion 79 may be formed in an inverted V-shaped crest. Although it is not shown, in ditch 77 and convex portion 79, a valley bottom of the V groove and an apex of the inverted-V shaped crest are curved, and a so-called waveform of a sine wave shape may be configured. Although it is not shown, ditch 77 and convex portion 79 may be a recessed groove having a flat groove bottom and a protruding convex portion 79 having a flat apex.

In filter 65, ditches 77 and convex portions 79 of irregular surface 81 may be arranged in a different pattern.

As shown in FIG. 7, the surface of filter 65A may be irregular surface 81A in which ditches 77A and convex portions 79A extending in a direction inclined in the long-side direction of duct 53 are alternately disposed in the long-side direction of ceiling surface 71 of the duct. A pair of frame body 69A is parallel with each other on both ends in the extension directions of ditches 77A and convex portions 79A extending in the inclination direction, and is bonded to each other while filter main body 67A is interposed therebetween.

As shown in FIG. 8, the surface of filter 65B may be irregular surface 81B in which ditches 77B and convex portions 79B extending in parallel in the long-side direction of duct 53 are alternately disposed in the short-side direction of ceiling surface 71 of the duct. A pair of frame body 69B is parallel with each other on both ends in the extension directions of ditches 77B and convex portions 79B extending in parallel with each other, and is bonded to each other while filter main body 67B is interposed therebetween.

In the present embodiment, thru-beam type filter 85 shown in FIGS. 5 and 9 is attached so as to cover exhaust opening surface 83 (refer to FIG. 2) of exhaust fan 49. As shown in FIG. 9, the surface of thru-beam type filter 85 is also formed to have irregular surface 81 in which ditches 77 and convex portions 79 parallel with each other are alternately disposed. Since thru-beam type filter 85 has irregular surface 81, the surface area is increased. Thru-beam type filter 85 passes container exhaust gas 87 (see below) which flows into via exhaust port 63. Similar to filter 65, thru-beam type filter 85 is also detachably attached to exhaust opening surface 83.

Next, an operation of multi-function printer 11 having the above-described configuration will be described.

In multi-function printer 11, the unfused toner image corresponding to the print job data input from the external device is transferred to sheet 37 and is transported to fuser unit 23. In fuser unit 23, sheet 37 is held by heat roller 41 and pressure roller 43. The unfused toner image carried to sheet 37 becomes an image fused on sheet 37 and is fused by heating of heat roller 41 and pressurizing of pressure roller 43.

At this time, in fuser unit 23, it is known that a very small quantity of toner configuring the unfused toner image is separated from the unfused toner image along water vapor according to vaporization of water included in sheet 37. In general, the toner is configured of pigment, wax, and an external additive. A primary effect of the external additive is to improve response efficiency between the external additive and static electricity, and for example, is used to attach minute particles such as silica on the toner surface. In recent years, there is a report that it is considered that the external additive particularly separated along with water vapor is one of factors increasing ultrafine particles (UFP) in multi-function printer 11.

In the present embodiment, the external additive separated from the toner surface along with the water vapor generated during the fusing of sheet 37 is carried to the upper portion of fuser unit container 51 along with air which is moved by natural convection and a suction force by exhaust fan 49. First side wall 57 which is a portion of wall portion 55 is positioned on the upper portion of fuser unit container 51. First side wall 57 becomes a partition between duct 53 provided to be adjacent to fuser unit container 51 and first side wall. Duct 53 is formed in a long shape in the direction along axis 59 of heat roller 41. That is, duct 53 is disposed to be adjacent in parallel with fuser unit 23 across the partition, and thus, compactification of multi-function printer 11 is realized. Exhaust port 63 is formed on first side wall 57 which is the partition, and exhaust port 63 causes the inside of fuser unit container 51, that is, an exposure space of fuser unit 23, and the inside (air transport space 61) of duct 53 to communicate with each other.

In duct 53, the air of air transport space 61 flows toward one end side in the long-side direction by exhaust fan 49 which is provided on one end side in the long-side direction. Accordingly, the air inside fuser unit container 51 is sucked into and flows into air transport space 61 of duct 53 which reaches a negative pressure via exhaust port 63. The external additive (ultrafine particles: UFP) separated from the toner surface along with the water vapor generated during the fusing of sheet 37 is mostly included in suction air (hereinafter, referred to as "container exhaust gas") along with other volatile organic compounds (VOC) and dust, and flows into air transport space 61 of duct 53.

When container exhaust gas 87 shown in FIGS. 2 and 3 is transferred to one end side in the long-side direction of duct 53, the container exhaust gas comes into contact with the surface of planar filter 65 which is attached in parallel with the inner wall surface of duct 53. Filter 65 and container exhaust gas 87 come into contact with each other, and thus, it is confirmed that the ultrafine particles (UFP) included in container exhaust gas 87 are captured by filter 65. Specifically, it is possible to confirm the capturing of ultrafine particles by measuring the amount of emission of the ultrafine particles at the outlet side of exhaust fan 49 when filter 65 is provided in duct 53 and when filter 65 is not provided in duct 53. It is considered that the reason why the ultrafine particles are captured by filter 65 disposed in parallel with container exhaust gas 87 is because container exhaust gas 87 becomes turbulent in the vicinity of the surface of filter 65 and as a result, a vortex is generated, and thus, the ultrafine particles are caught on the surface of filter 65 and therefore, are captured.

In filter 65, as the base material, vegetable fibers, mineral fibers, synthetic fibers, woven fabrics, non-woven fabrics, felts, webs, resin foamed bodies, porous films, or the like may be used. Even when any base material is used, lots of minute voids, that is, fiber clearances and holes are formed on the surface of filter 65.

In a portion in which container exhaust gas 87 flowing to air transport space 61 of duct 53 is far away from filter 65, the container exhaust gas uniformly flows and thus, a velocity gradient (velocity change) is not generated. Meanwhile, since sliding is not generated on the surface of filter 65, flow velocities are continuously changed by influence of a friction force in the vicinity of filter 65, and a region in which uniform flow is generated is formed. That is, a thin layer (boundary layer) having a great velocity gradient is covered on the surface of filter 65. It is considered that the ultrafine particles, in which transport energy is decreased by the boundary layer and the above-described vortex generated by the turbulence, are caught on minute voids on the filter surface and are captured. The boundary layer is changed by ultrafine particles (UFP) which are captured and deposited. It is considered that there are optimal values with respect to a relationship between the ultrafine particles (UFP) and the sizes of the minute voids, and the flow velocity of container exhaust gas 87.

In this way, in the present embodiment, since duct 53 is disposed in the vicinity of fuser unit 23 along axis 59 of heat roller 41, a wasteful space is not generated in multi-function printer 11. As a result, the configuration itself of multi-function printer 11 becomes simple and compact.

More specifically, in the present embodiment, duct 53 is also used as a portion of wall portion 55 of fuser unit container 51, and thus, it is possible to easily manufacture multi-function printer 11. Since duct 53 is disposed to be adjacent to fuser unit container 51 along (in parallel with) heat roller 41 only across the partition, wasteful space is not generated in multi-function printer 11. As a result, the configuration itself of multi-function printer 11 becomes simple and compact. It is also possible to easily replace filter 65, and thus, it is possible to improve maintenance of multi-function printer 11.

Since filter 65 is configured in a long shape along the long-side direction of duct 53, a contact time between container exhaust gas 87 and the filter is lengthened, probability of the ultrafine particles (UFP) being captured is increased, and it is possible to decrease the amounts of the ultrafine particles (UFP) exhausted to the outside of multi-function printer 11. Filter 65 does not cross air transport space 61 of duct 53, and is installed in parallel with the transport direction of container exhaust gas 87 in air transport space 61. Accordingly, unlike the thru-beam type filter in the related art, filter 65 can prevent an increase of resistance when air is transported, and in other words, filter 65 can prevent an increase of output of the exhaust fan.

In multi-function printer 11, filter 65 is installed on ceiling surface 71 of the duct, and thus, it is possible to allow container exhaust gas 87 including the water vapor generated during the fusing of sheet 37 and ultrafine particles (UFP) having buoyancy generated by ascending current to effectively come into contact with filter 65. Particularly, since container exhaust gas 87 immediately after exhaust fan 49 is stopped is moved at a low flow velocity in the vicinity of ceiling surface 71 of the duct and thereafter, the container exhaust gas stagnates, it is possible to effectively capture the ultrafine particles (UFP).

In multi-function printer 11, ceiling surface 71 of the duct is formed to be upwardly inclined so as to be heightened as ceiling surface 71 is away from exhaust port 63, and the included angle between second side wall 73 and ceiling surface 71 of the duct becomes an acute angle. Accordingly, air transport space 61 interposed between second side wall 73 and filter 65 becomes a corner space which is gradually narrowed toward the upper portion. In the corner space, by friction forces of second side wall 73 and filter 65, the flow velocity during the exhaust is gradually decreased toward the inner side which is the side remote from exhaust fan 49. It is assumed that container exhaust gas 87 including the ultrafine particles (UFP) which moves upwardly along with the water vapor ascends toward the corner space. Accordingly, it is possible to deposit the ultrafine particles (UFP) on filter 65 from the inner side of the corner space. As a result, it is possible to effectively use the surface of filter 65 from the inner side of the corner space.

In multi-function printer 11, filter 65 having irregular surface 81 in which ditches 77 and convex portions 79 are alternately disposed is installed in the transport direction of container exhaust gas 87. Transported container exhaust gas 87 repeatedly collides with ditches 77 and convex portions 79, and thus, a vortex is generated. Accordingly, in filter 65, it is possible to improve probability of the ultrafine particles (UFP) being captured by minute voids of filter 65 itself.

In multi-function printer 11, the plurality of exhaust ports 63 are provided, and the gap and the area of each exhaust port 63 are appropriately set. Accordingly, compared to a case where one exhaust port 63 is provided, it is possible to suppress variation in an inflow amount of container exhaust gas 87 flowing in air transport space 61 of duct 53 in the long-side direction of duct 53.

In multi-function printer 11, container exhaust gas 87 passes through air transport space 61 of duct 53, and thus, container exhaust gas 87 including the exhaust emissions from fuser unit 23 is exhausted from exhaust opening surface 83 of exhaust fan 49 in a state where the ultrafine particles (UFP) are decreased. At this time, container exhaust gas 87 including the exhaust emissions from fuser unit 23 passes through thru-beam type filter 85, and thus, the remaining ultrafine particles are captured again. Thru-beam type filter 85 is provided over the entire cross-section of duct 53, and thus, it is possible to capture ultrafine particle secondarily. Filter 65 inside duct 53 and thru-beam type filter 85 may be installed so that filter performance is appropriately adjusted. For example, a replacement period of filter 65 inside duct 53 may be set to be lengthened, and a replacement period of thru-beam type filter 85 may be set to be shortened.

Here, in the configuration of the related art in which filter 65 is not provided in duct 53, the decrease of the ultrafine particles (UFP) is dependent on only thru-beam type filter 85. In this case, when thru-beam type filter 85 is thickened to improve capture performance of ultrafine particles (UFP), exhaust fan 49 having greater power is required, and thus, noise is also increased.

In contrast, in multi-function printer 11 of the present embodiment including filter 65 in duct 53, thru-beam type filter 85 may have an auxiliary performance. Accordingly, in multi-function printer 11 of the present embodiment, air resistance is not increased even when thru-beam type filter 85 is attached, and it is possible to suppress an increase in the output of exhaust fan 49.

In filter 65, filter main body 67 is formed in the irregular shape in which ditches 77 and convex portions 79 are alternately disposed. Frame body 69 is bonded to both ends orthogonal to an irregularity direction of filter main body 67. "Both ends orthogonal to the irregularity direction" are a pair of ends which is positioned on both sides toward a direction in which irregularities are arranged. Since frame body 69 is fixed to both ends of filter main body 67, extension and contraction, for example, of the filter 65 are regulated like an accordion, in the irregularity direction. That is, in filter 65, pitch of the irregularities (ditch 77 (convex portion 79) and ditch 77 (convex portion 79)) is not easily changed, and optimal pitch is always maintained. Accordingly, shape stability is increased, and handling becomes easy.

In filter 65, convex portions 79 protrude from frame body 69, and the entire region of convex portions 79 can be fixed so as to be bonded to the surface to be fixed. Accordingly, a sufficient bonding area is obtained. When the surface of filter 65 is attached so as to be parallel with respect to the flow of air including removal materials, the front and rear convex portions 79 protrude from frame body 69 into the flow of the air. Accordingly, the flow of the air is not blocked by frame body 69, the air directly abuts the surfaces of convex portions 79 also in the vicinity of frame body 69, and easily comes into contact with the surfaces of convex portions 79. Therefore, efficiency of capturing the ultrafine particles is increased.

In filter 65, since the front and rear convex portions 79 protrude from frame body 69, even when convex portions 79 are bonded so as to be fixed to the inner wall surface, ditches 77 opposing the inner wall surface are opened to air transport space 61 of duct 53. That is, it is possible to allow the front and the rear of filter main body 67 to communicate with air transport space 61. Therefore, according to filter 65 in which ditches 77 and convex portions 79 protrude from frame body 69, a closed space is not generated between the filter and the inner wall surface, and thus, it is possible to increase the efficiency of capturing the ultrafine particles.

In filter 65, ditches 77 and convex portions 79 extend so as to be orthogonal to the long-side direction of duct 53. That is, ditches 77 and convex portions 79 are alternately disposed in the long-side direction of duct 53. Container exhaust gas 87 flowing into air transport space 61 of duct 53 from exhaust port 63 of first side wall 57 flows toward the direction approaching ceiling surface 71 of the duct by ascending current including water vapor. Particularly, the flow in the direction approaching ceiling surface 71 of the duct is remarkably generated immediately after exhaust fan 49 is stopped. Container exhaust gas 87 approaching ceiling surface 71 of the duct abuts the surface of filter 65 attached to ceiling surface 71 of the duct. At this time, ditches 77 and convex portions 79 extend so as to be orthogonal to first side wall 57 on the surface of filter 65. Accordingly, in filter 65, container exhaust gas 87 flowing in the long-side direction of duct 53 after flowing from exhaust port 63 easily abuts convex portions 79. Container exhaust gas 87 collides with convex portions 79, and thus, turbulence is easily generated, and numerous vortexes are generated in the vicinity of filter 65. As a result, in filter 65, probability of capturing the ultrafine particles at minute voids of filter 65 itself is improved.

In filter 65A, ditches 77A and convex portions 79A extend in the inclined direction in the long-side direction of duct 53. As for the "inclination in the long-side direction of duct 53", two inclination directions are considered. One inclination direction is an inclination direction (separation inclination direction) in which the inclination end of one end side (exhaust fan 49 side) in the long-side direction of the duct of ditch 77A and convex portion 79A positioned on ceiling surface 71 of the duct is away from first side wall 57. On the other hand, the other inclination direction is an inclination direction (approach inclination direction) in which the inclination end of exhaust fan 49 side of ditch 77A and convex portion 79A positioned on ceiling surface 71 of the duct approaches first side wall 57.

Initially, container exhaust gas 87 flowing toward exhaust fan 49 in air transport space 61 of duct 53 flows into duct 53 in a direction orthogonal to the long-side direction of duct 53 from exhaust port 63 of first side wall 57. That is, the flow direction of container exhaust gas 87 is gradually curved from exhaust port 63, and is changed into a perpendicular direction. Strictly speaking, the flow direction becomes three-dimensional complicated flow lines which interfere with one another.

When ditches 77A and convex portions 79A are in the "separation inclination direction", container exhaust gas 87 immediately after the container exhaust gas flows from exhaust port 63 easily flows to the downstream side without inversely flowing along the extension directions of ditches 77A and convex portions 79A. Accordingly, ditches 77A and convex portions 79A in the separation inclination direction easily come into contact with container exhaust gas 87 over the entire length in the extension direction. As a result, in the separation inclination direction, the time when ditches 77A and convex portions 79A come into contact with container exhaust gas 87 is lengthened.

Meanwhile, when ditches 77A and convex portions 79A are in the "approach inclination direction", container exhaust gas 87 immediately after the container exhaust gas flows from exhaust port 63 easily abuts the convex portions in a direction approximately orthogonal to the extension direction of convex portion 79A. That is, container exhaust gas 87 collides with convex portions 79A, turbulence is easily generated, and numerous vortexes are generated in the vicinity of filter 65. As a result, in ditches 77A and convex portions 79A in the approach inclination direction, probability of the ultrafine particles being captured by the minute voids of filter 65 itself is improved.

Which of the approach inclination direction and the separation inclination direction can capture more ultrafine particles can be confirmed by measuring the amounts of emission of the ultrafine particles in the outlet side of exhaust fan 49. As a result of the confirmation, it is understood that compared to the separation inclination direction, ditches 77A and convex portions 79A in the approach inclination direction increase efficiency of capturing the ultrafine particles.

In filter 65B, ditches 77B and convex portions 79B extend so as to be parallel to the long-side direction of duct 53. Container exhaust gas 87 flowing into air transport space 61 of duct 53 from exhaust port 63 of first side wall 57 flows toward the direction approaching ceiling surface 71 of the duct by ascending current including water vapor. Particularly, the flow in the direction approaching ceiling surface 71 of the duct is remarkably generated immediately after exhaust fan 49 is stopped. Container exhaust gas 87 approaching ceiling surface 71 of the duct abuts the surface of filter 65B attached to ceiling surface 71 of the duct. At this time, ditches 77B and convex portions 79B extend so as to be parallel to first side wall 57 on the surface of filter 65B. Accordingly, in filter 65B, container exhaust gas 87 immediately after flowing from exhaust port 63 easily abuts convex portions 79B with a wider surface area. Container exhaust gas 87 collides with convex portions 79B, and thus, turbulence is easily generated, and numerous vortexes are generated in the vicinity of filter 65B. As a result, in filter 65B, probability of capturing the ultrafine particles at minute voids of filter 65B itself is improved.

When ditches 77B and convex portion 79B extend so as to be parallel in the longitudinal direction of duct 53, container exhaust gas 87 flowing toward one end side in the long-side direction of duct 53 flows along ditches 77B and convex portions 79B. Accordingly, it is possible to suppress an increase of resistance during the air is transported. As a result, it is possible to suppress an increase in output of exhaust fan 49 or noise (sound generated when the air passes through duct 53).

As described above, various embodiments are described with reference to the drawings. However, it goes without saying that the present invention is not limited to the examples. It is clear to a person skilled in the art that various modifications and corrections may be applied within a scope described in claims, and various modifications and corrections are included in the technical range of the present invention.

According to the embodiments of the present invention, the present invention is useful as the image forming apparatus which decreases the amount of emission of the ultrafine particles and suppresses the increase in the output of the exhaust fan by the simple structure.

What is claimed is:

1. An image forming apparatus comprising:

a fuser unit including a heat roller and a pressure roller, which heats and pressurizes a sheet on which an unfused toner image is carried and fuses the unfused toner image on the sheet;

a duct formed in a long shape in a longitudinal direction along a longitudinal axis of the heat roller, which is disposed in the vicinity of the fuser unit along the longitudinal axis of the heat roller;

an exhaust fan provided adjacent to one longitudinal end of the duct;

an exhaust port, which is opened in a first side wall of the duct facing the fuser unit and causes the fuser unit and the duct to communicate with each other; and a planar filter which is attached to an inner wall surface of the duct, wherein the planar filter includes, a filter base material having a surface shape in which ditches and convex portions are alternately disposed; and a frame which is bonded to two opposing ends of the filter base material where both ends of each of the ditches and convex portions meet, respectively, wherein the convex portion of the filter base material protrudes from the frame, and wherein the convex portion of the filter base material is bonded or stuck to the inner wall surface.

2. The imaging forming apparatus of claim 1, further comprising a fuser unit container which accommodates the fuser unit, wherein the first side wall is a portion of a wall of the fuser unit container.

3. The imaging forming apparatus of claim 1, wherein the planar filter is stuck to the inner wall surface of the duct so as to be parallel with the inner wall surface.

4. The imaging forming apparatus of claim 1, wherein the inner wall surface of the duct is a ceiling surface of the duct.

5. The imaging forming apparatus of claim 1, wherein in the surface shape the ditches and convex portions extend in a direction orthogonal to the longitudinal direction of the duct.

6. The imaging forming apparatus of claim 1, wherein in the surface shape the ditches and convex portions extend at an inclined angle to the longitudinal direction of the duct.

7. The imaging forming apparatus of claim 1, wherein in the surface shape the ditches and the convex portions extend in parallel to the longitudinal direction of the duct.

8. The imaging forming apparatus of claim 1, wherein a plurality of the exhaust ports are opened in the first side wall.

9. The imaging forming apparatus of claim 1, wherein a thru-beam type filter which passes exhaust emissions from the fuser unit is attached to an exhaust opening surface of the exhaust fan.

* * * * *